US009401122B2

(12) United States Patent
Jo et al.

(10) Patent No.: US 9,401,122 B2
(45) Date of Patent: Jul. 26, 2016

(54) DISPLAY PANEL

(71) Applicant: SAMSUNG DISPLAY CO., LTD., Yongin, Gyeonggi-Do (KR)

(72) Inventors: Young-Eun Jo, Seoul (KR); Kyoung-Ju Shin, Hwaseong-si (KR); Chong-Chul Chai, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 14 days.

(21) Appl. No.: 14/322,983

(22) Filed: Jul. 3, 2014

(65) Prior Publication Data

US 2014/0313184 A1 Oct. 23, 2014

Related U.S. Application Data

(62) Division of application No. 12/942,705, filed on Nov. 9, 2010, now abandoned.

(30) Foreign Application Priority Data

Jun. 15, 2010 (KR) ..... 10-2010-0056644

(51) Int. Cl.
*G09G 5/00* (2006.01)
*G09G 3/36* (2006.01)

(52) U.S. Cl.
CPC ..... *G09G 5/00* (2013.01); *G09G 3/3677* (2013.01); *G09G 2300/0408* (2013.01)

(58) Field of Classification Search
CPC G09G 5/00; G09G 3/3677; G09G 2300/0408
USPC ..... 345/212
See application file for complete search history.

(56) References Cited

U.S. PATENT DOCUMENTS

| | | | |
|---|---|---|---|
| 5,506,375 | A | 4/1996 | Kikuchi |
| 7,381,987 | B2 | 6/2008 | Lee et al. |
| 7,502,007 | B2 | 3/2009 | Ishii |
| 7,965,367 | B2 | 6/2011 | Oohira |
| 2004/0135757 | A1 | 7/2004 | Park et al. |
| 2005/0146493 | A1 | 7/2005 | Kinjo et al. |
| 2007/0070021 | A1 | 3/2007 | Ahin et al. |
| 2008/0024407 | A1 | 1/2008 | Yamaguchi |
| 2008/0186304 | A1 | 8/2008 | You et al. |
| 2008/0204619 | A1 | 8/2008 | Saitou et al. |
| 2009/0189839 | A1 | 7/2009 | Ko et al. |

FOREIGN PATENT DOCUMENTS

| | | | |
|---|---|---|---|
| JP | 2002-040483 | A | 2/2002 |
| JP | 2003-202592 | A | 7/2003 |
| JP | 2004-070336 | A | 3/2004 |
| JP | 2008-032920 | A | 2/2008 |
| KR | 1020040077181 | A | 9/2004 |
| KR | 10-0487358 | B1 | 4/2005 |

(Continued)

*Primary Examiner* — Aneeta Yodichkas
*Assistant Examiner* — Joseph Fox
(74) *Attorney, Agent, or Firm* — Cantor Colburn LLP

(57) ABSTRACT

A display panel includes a display area including a gate line and a data line, a gate driver integrated on a substrate and connected to one end of the gate line, the gate driver including a plurality of a stage, a signal line connected to the stages; and a blocking member disposed on the signal line and overlapped with the signal line, the blocking member including a plurality of an opening.

20 Claims, 10 Drawing Sheets

(56) References Cited

FOREIGN PATENT DOCUMENTS

| | | | |
|---|---|---|---|
| KR | 1020060020316 | A | 3/2006 |
| KR | 1020070075801 | A | 7/2007 |
| KR | 1020080001975 | A | 1/2008 |

DISPLAY PANEL

This application is a divisional application of U.S. application Ser. No. 12/942,705 filed Nov. 9, 2010, which claims priority to Korean Patent Application No. 10-2010-0056644 filed on Jun. 15, 2010, and all the benefits accruing therefrom under 35 U.S.C. §119, the entire contents of which are incorporated herein by reference.

BACKGROUND OF THE INVENTION (a) Field of the Invention

There is provided a display panel.

(b) Description of the Related Art

Flat panel displays such as a liquid crystal display ("LCD"), an organic light emitting diode ("OLED") display, and an electrophoretic display, a plasma display, and the like include plural pairs of electric field generating electrodes, and an electro-optical active layer interposed therebetween. The liquid crystal display includes a liquid crystal layer as the electro-optical active layer, and the organic light emitting display includes an organic light emitting layer as the electro-optical active layer. Any one of a pair of electric field generating electrodes is generally connected to a switching element to receive an electric signal, and the electro-optical active layer converts the electric signal into an optical signal to display images.

The display device includes a gate driver and a data driver. The gate driver or the data driver may be integrated on a panel while being patterned together with a gate line, a data line, a thin film transistor, and the like. The integrated gate driver or data driver does not need an additional gate driving chip or a data driving chip. Therefore, the manufacturing cost of each driver may be saved. Further, even in the case in which the additional driving chip is provided, a signal line connecting a signal controller with the driving chip may be integrated on the panel while being patterned together with the gate line, the data line, the thin film transistor, and the like.

BRIEF SUMMARY OF THE INVENTION

An exemplary embodiment of the invention provides a display panel that includes a display area including a gate line and a data line, a gate driver connected to one end of the gate line, including a plurality of a stage and integrated on a substrate, a signal line connected to the stages, and a blocking member disposed on the signal line, overlapped with the signal line, and including a plurality of an opening.

The signal line may be disposed on the same layer as the gate line or the data line.

Direct current ("DC") voltage may be applied to the blocking member. The DC voltage may be low voltage.

The signal line may include at least one of a scan signal line and a clock signal line. Each of the stages may include a clock input terminal and the clock signal line is connected to the clock input terminal.

The signal line may include a voltage signal line for applying the low voltage. Each of the stages may include a voltage input terminal, and the voltage signal line is connected to the voltage input terminal.

The panel may further include a signal controller controlling the gate driver, and the signal line may connect the gate driver with the signal controller.

The blocking member may have a mesh shape.

The openings may be disposed at a first region where the signal line and the blocking member are overlapped with each other.

The openings may be disposed at a second region where the signal line and the blocking member are not overlapped with each other.

The openings may not be disposed at the second region where the signal line and the blocking member are not overlapped with each other.

The blocking member may include a transparent conductive material.

The display panel may further include a pixel electrode disposed on the gate line and the data line, and the blocking member may be disposed on the same layer as the pixel electrode.

The display panel may further include a data driver applying data voltage to the data line, and the signal line comprises a data signal line connected to the data driver. The blocking member may be disposed on the data signal line and may be overlapped with the data signal line.

The data signal line may include at least one of a negative data signal line and a positive data signal line.

The panel may further include a signal controller controlling the data driver, and the data signal line may connect the data driver with the signal controller.

The openings may be disposed at a third region where the data signal line and the blocking member are overlapped with each other.

The openings may be disposed at a fourth region where the data signal line and the blocking member are not overlapped with each other.

The openings may not be disposed at the fourth region where the data signal line and the blocking member are not overlapped with each other.

Each of the stages may include a first input terminal, a second input terminal, an output terminal, and a transmission signal output terminal. The stages may include a first stage and a second stage. A transmission signal output terminal of the first stage may be connected to a first input terminal of the second stage, and a second input terminal of the first stage may be connected to an output terminal of the second stage.

The signal line may include a scan start signal line which may be connected to the first input terminal of the first stage.

Each of the stages may include an input unit, a pull-up driving unit, a pull-down driving unit, an output unit, and a transmission signal generation unit.

The input unit, the pull-down driving unit, the output unit, and the transmission signal generation unit may be connected to a first node.

According to the exemplary embodiment of the invention, resistive capacitive ("RC") delay may be reduced, and noise generated between signal lines may be reduced.

BRIEF DESCRIPTION OF THE DRAWINGS

The above and other features of this disclosure will become more apparent by describing in further detail exemplary embodiments thereof with reference to the accompanying drawings, in which.

DETAILED DESCRIPTION OF THE INVENTION

Figure 1:
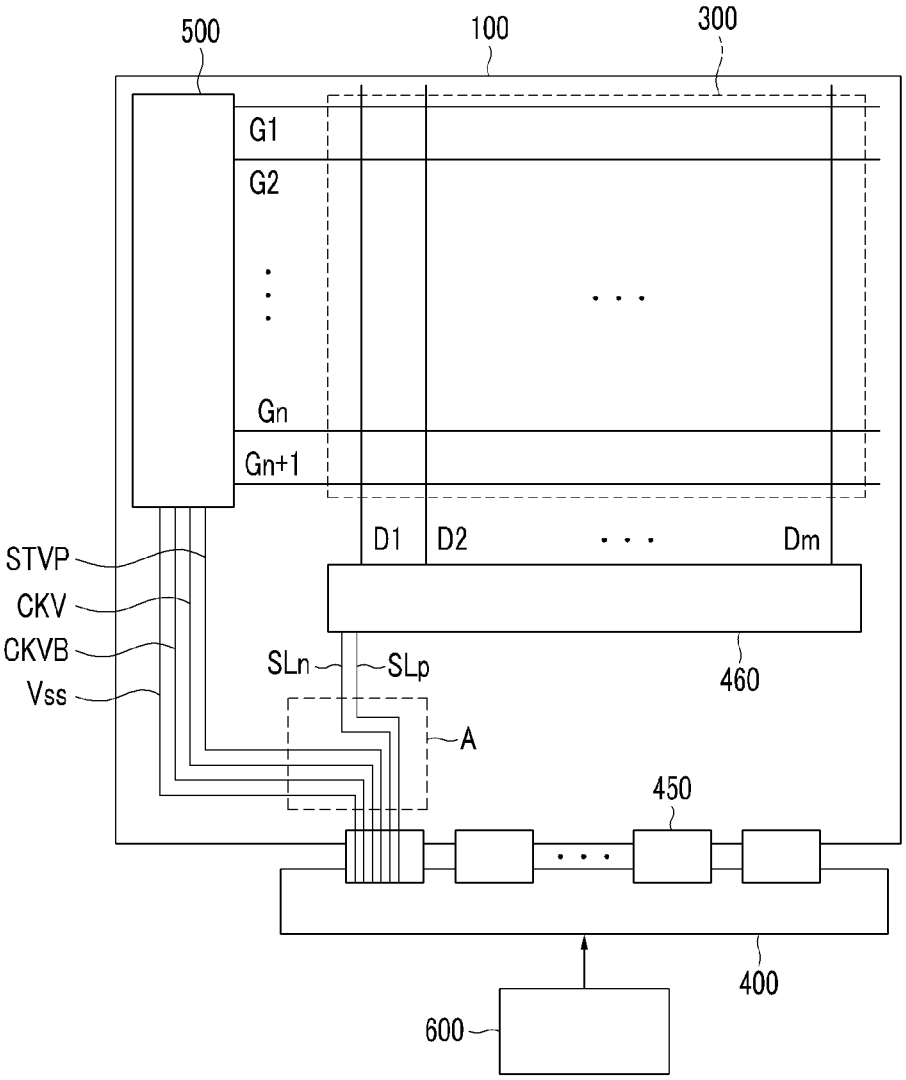
FIG. 1 is a schematic diagram of an exemplary embodiment of a display panel, according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the invention. The drawings and description are to be regarded as illustrative in nature and not restrictive. Like reference numerals designate like elements throughout the specification. Further, a detailed description of the widely known related art will be omitted. In the drawings, the thickness of layers, films, panels, regions, etc., are exaggerated for clarity.

It will be understood that when an element such as a layer, film, region, or substrate is referred to as being "on" or "connected to" another element, it can be directly on or directly connected to the other element, or intervening elements may also be present. It will be understood that when an element is referred to as being directly "on" or direct "connected to" another element, no intervening element is present. As used herein, connected may refer to elements being physically and/or electrically connected to each other. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "above," "upper" and the like relative to another element, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly. It will be understood that when an element is referred to as being "just beneath" another element, no intervening element is present.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the invention will be described in detail with reference to the accompanying drawings.

An exemplary embodiment of a display panel, according to the invention will be described in detail with reference to FIGS. 1 to 3.

Figure 2:
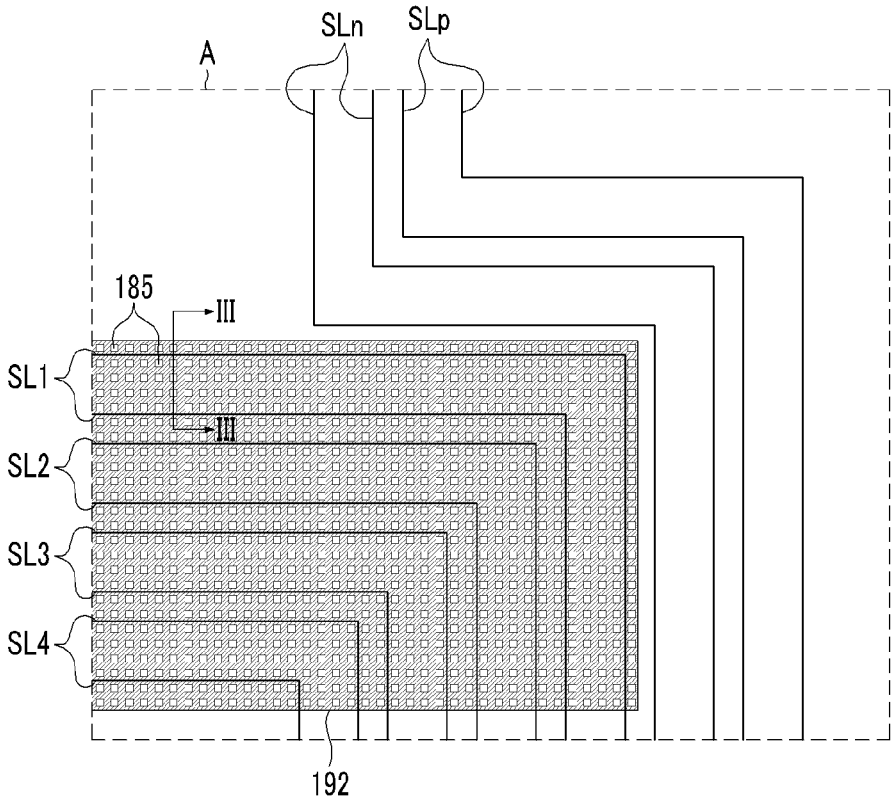
FIG. 2 is a plan view illustrating an area A of the display panel of FIG. 1.
Figure 3:
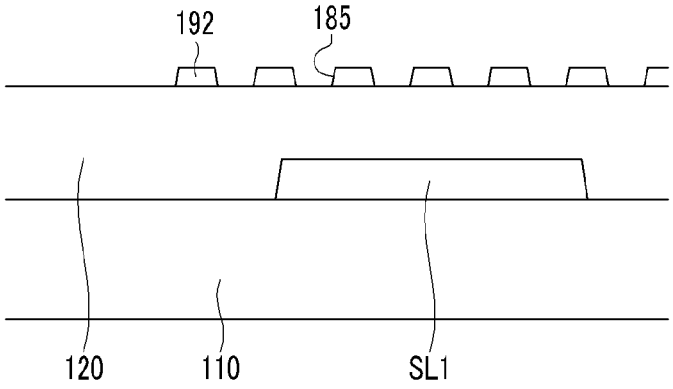
FIG. 3 is a cross-sectional view taken along line III-III of FIG. 2.

FIG. 1 is a schematic diagram of the exemplary embodiment of the display panel, according to the invention, FIG. 2 is a plan view illustrating an area A of the display panel of FIG. 1, and FIG. 3 is a cross-sectional view taken along line III-III of FIG. 2.

Referring to FIG. 1, the display panel 100 includes a display area 300 displaying images, and a gate driver 500 applying gate voltage to gate lines G1 to Gn+1 of the display area 300. Data lines D1 to Dm of the display area 300 receive data voltage from a data driver 460.

The gate driver 500, the data driver 460, and at least one of signals lines connecting a signal controller 600 with the gate driver 500 and/or the data driver 460 may be integrated on the display panel 100. In one exemplary embodiment, for example, when the gate lines G1 to Gn+1, the data lines D1 to Dm, a thin film transistor, and other elements of the display area 300 are formed, the gate driver 500, the data driver 460, and at least one of the signals lines connecting the signal controller 600 with the gate driver 500 and/or the data driver 460 may be formed in a same process and/or at substantially a same time. The aforementioned process is called chip on glass ("COG").

The gate drivers 500 and the data driver 460 are controlled by the signal controller 600. A printed circuit board ("PCB") 400 is disposed outside a flexible printed circuit ("FPC") film 450 to transmit a signal from the signal controller 600 to the data driver 460 and/or the gate driver 500. As used herein, "outside" indicates separate from the FPC film 450.

The signal provided from the signal controller 600 may include, but is not limited to, clock signals CKV and CKVB, a scan start signal STVP, and a signal providing predetermined voltage Vss. Further, the signal provided from the signal controller 600 may include a load signal for applying data voltage from the data driver 460 to the data lines D1 to Dm, an inversion control signal for inverting a data signal, a negative data signal SLn having a value lower than common voltage, and a positive data signal SLp. In an alternative embodiment, the data driver 460 may be disposed within the FPC film 450, and would therefore not be outside of the FPC film 450.

The display area 300 may include the thin film transistor. In the case of the liquid crystal display panel, the display area 300 may include a liquid crystal capacitor, and the like, and in the case of the organic light emitting display panel, the display area 300 may include an organic light emitting diode. Other members or elements included in the display area 300 may be determined depending on the kind of the display panel, such as the plasma display panel, the electrophoretic display panel, and the like.

Hereinafter, as the display panel 100, the liquid crystal display panel will be described in the exemplary embodiment.

The display area 300 includes a plurality of gate lines G1 to Gn+1 and a plurality of data lines D1 to Dm. The plurality of gate lines G1 to Gn+1 and the plurality of data lines D1 to Dm are insulated and cross each other in the plan view of the display panel 100.

In one exemplary embodiment, a pixel may include the thin film transistor, the liquid crystal capacitor, and a storage capacitor. Alternatively, the storage capacitor may be omitted. A control terminal of the thin film transistor is connected to the gate line, and an input terminal of the thin film transistor is connected to the data line. An output terminal of the thin film transistor may be connected to a pixel electrode which is one terminal of the liquid crystal capacitor, and may also be connected to one terminal of the storage capacitor. The other terminal of the liquid crystal capacitor is connected to a common electrode. A liquid crystal layer is disposed between both terminals of the liquid crystal capacitor. The other terminal of the storage capacitor may receive storage voltage applied from the signal controller 600.

The plurality of data lines D1 to Dm receive the data voltage from the data driver 460, and the plurality of gate lines G1 to Gn+1 receive gate voltage from the gate driver 500.

A single one of the data driver 460 is disposed in the lower part of the display panel 100 as illustrated in the plan view of FIG. 1, and is connected to each of the data lines D1 to Dm that extend in a column (e.g., first) direction. Alternatively, the data driver 460 may be disposed in an upper part of the display panel 100 in the plan view.

The gate driver 500 generates gate voltage (gate-on voltage and gate-off voltage) by receiving the clock signals CKB and CKVB, the scan start signal STVP, and the low voltage Vss corresponding to gate-off voltage, and sequentially applies the gate-on voltage to the gate lines G1 to Gn+1.

The clock signals CKV and CKVB, the scan start signal STVP, and the voltage Vss corresponding to the gate-off voltage applied to the gate driver 500 are applied to the gate driver 500 through the flexible printed circuit film 450 disposed at the outermost side of the display panel 100, as shown in FIG. 1. The signals are transmitted to the flexible printed circuit film 450 from an outside of the display panel 100 or from the signal controller 600 through the printed circuit board 400. In one exemplary embodiment, a number of the clock signals may be equal to, or more than two.

Referring to FIG. 2, a scan start signal line SL1 for transmitting the scan start signal STVP, clock signal lines SL2 and SL3 for transmitting the clock signal CKB and CKVB, and a voltage signal line SL4 for transmitting the low voltage Vss are disposed directly adjacent to each other in area A. A blocking member 192 is disposed above and overlapping each signal line SL1, SL2, SL3 and SL4. The blocking member 192 may be disposed above and overlapping various kinds of signal lines connected between the gate driver 500 and the signal controller 600, and are not limited to being above the signal lines SL1, SL2, SL3 and SL4.

The blocking member 192 is a single unitary indivisible member, which covers and overlaps a portion of each of the signal lines SL1 to SL4. The blocking member 192 is directly overlapped with the signal lines SL1 and SL4, and regions among (e.g., between) the signal lines SL1 to SL4, where a signal line is not disposed.

Further, the blocking member 192 receives direct current ("DC") voltage having a predetermined level. In one exemplary embodiment, for example, the blocking member 192 may receive the low voltage Vss corresponding to the gate-off voltage, or may receive additional voltage other than the low voltage Vss. Since the blocking member 192 covers the signal lines SL1 to SL4 while receiving the DC voltage having the predetermined level, the blocking member 192 may reduce noise which may be generated among the signal lines SL1 to SL4, and may reduce noise which may be generated in an adjacent negative data signal line SLn and a positive data signal line SLp.

Further, the blocking member 192 may have a mesh structure in the plan view, including a plurality of an opening 185. Each of the openings 185 penetrates completely through a thickness of the blocking member 192, and is at a distance from edges of the single unitary indivisible blocking member 192, such that the opening 185 is an enclosed opening solely defined by the blocking member 192.

As a result of the mesh structure of the blocking member 192, capacitance between the blocking member 192 and the signal lines SL1 to SL4 may be reduced, and resistive capacitive ("RC") delay of the display panel may be reduced. In one exemplary embodiment, for example, since the blocking member 192 including the plurality of openings 185 has capacitance smaller than a blocking member not including the openings, the RC delay of the display panel may be smaller.

The plurality of openings 185 may be arranged in the mesh structure where rows and columns of the openings 185 are parallel to each other, respectively, and where distances between adjacent rows and columns are substantially uniform. In the plan view, the openings 185 may have a square, a rectangular, a circular shape, and the like. The single unitary indivisible blocking member 192 may have a substantially rectilinear, e.g., rectangular, shape in the plan view.

The openings 185 of the blocking member 192 may all be substantially a same dimension and/or planar area, or the openings 185 may be varied in dimension and/or planar area. In one exemplary embodiment, for example, intervals among the plurality of openings 185 may be approximately 20 micrometers, and the opening 185 may be a square shape having a width and a length of approximately 5 micrometers. In this case, RC delay of the clock signal line CKV may be approximately 80.4 nanoseconds (ns). In contrast, when the blocking member without the opening covers the signal lines, the RC delay of the clock signal CKV may be approximately 321.5 ns.

Referring to FIG. 3, the signal lines SL1 to SL4 are disposed on a first insulating substrate 110. The signal lines SL1 to SL4 may be disposed on a same layer and include the same material as gate lines G1 to Gn+1, (121 in FIG. 7). In one exemplary embodiment, for example, the signal lines SL1 to SL4 may be formed in a process in which the gate lines G1 to Gn+1, 121 are formed, and at substantially the same time.

An insulating layer 120 is disposed above and overlapping the signal lines SL1 to SL4. The insulating layer 120 contacts an upper and side surfaces of the signal lines SL1 to SL4. The insulating layer 120 may include an inorganic insulating layer such as SiOx, SiNx, and the like, and/or an organic insulating layer.

Figure 7:
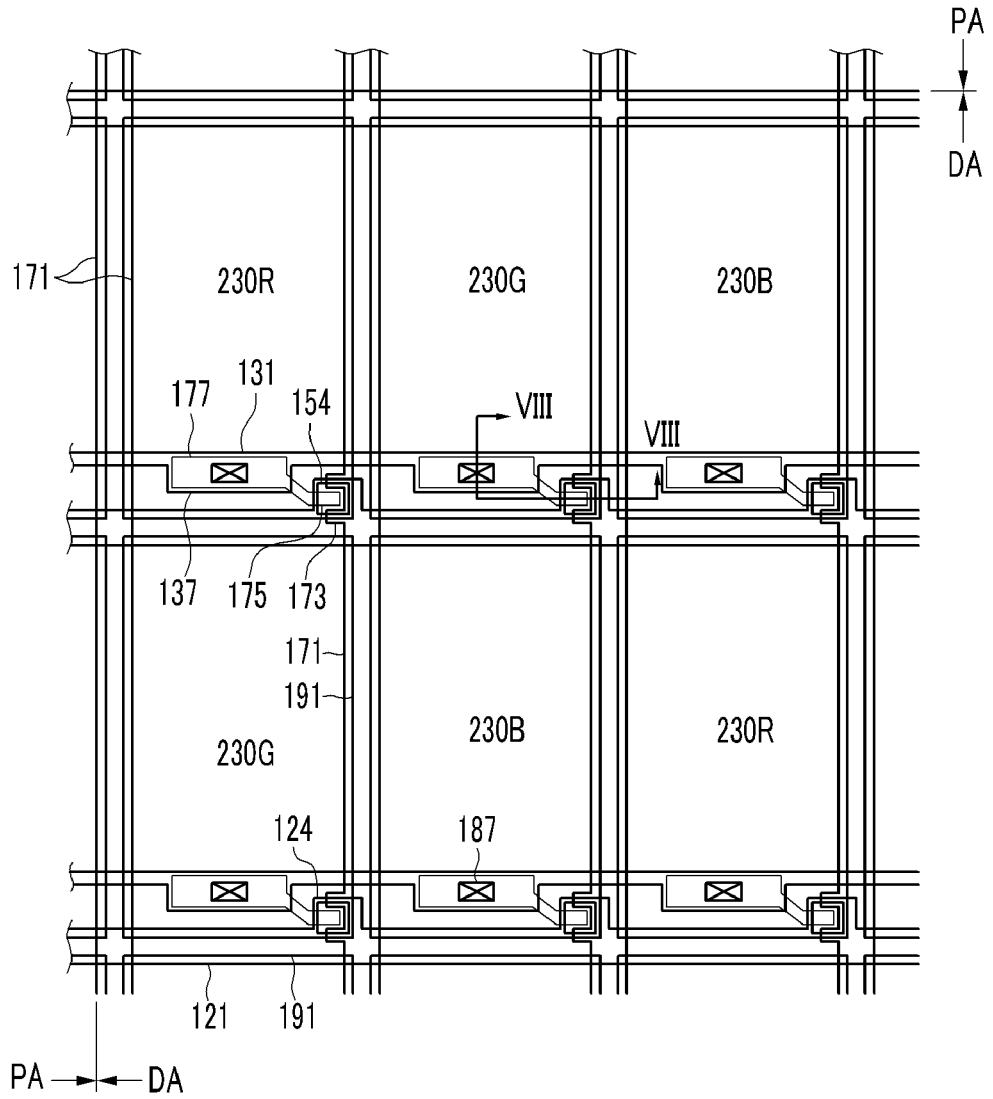
FIG. 7 is a plan view illustrating an exemplary embodiment of a portion of the display area of the display panel of FIG. 1.

The blocking member 192 is disposed above and overlapping the insulating layer 120. The blocking member 192 may include transparent conductive materials such as ITO, IZO, and the like. The blocking member 192 may be disposed on a same layer and include the same material as a pixel electrode 191 (FIG. 7). In one exemplary embodiment, for example, since the blocking member 192 may be formed at the same time in a process in which the pixel electrode 191 is formed, process cost may be saved.

Figure 4:
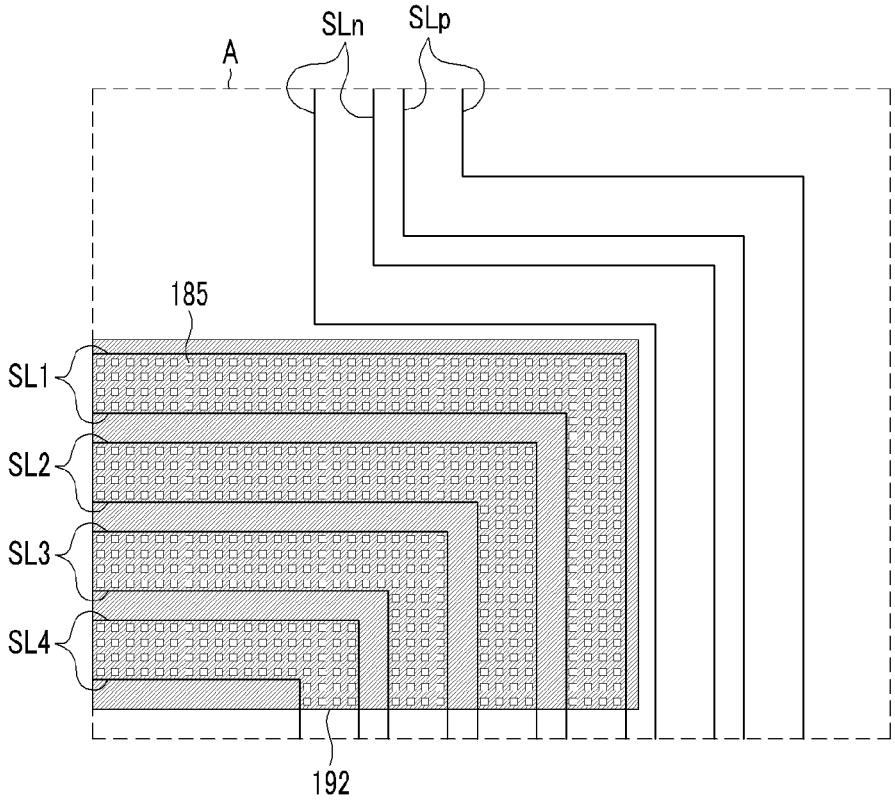
FIG. 4 is a plan view illustrating another exemplary embodiment of area A of the display panel of FIG. 1, according to the invention.

FIG. 4 is a plan view illustrating another exemplary embodiment of area A of the display panel, according to the invention.

Referring to FIG. 4, a blocking member 192 covers (e.g., overlaps) signal lines SL1 to SL4. That is, the blocking member 192 is overlapped with a portion of each of the signal lines SL1 and SL4 and regions among (e.g., between) the signal lines SL1 to SL4. The blocking member 192 includes a plurality of an opening 185. The plurality of openings 185 are disposed at first regions of the blocking member 192 where the blocking member 192 and the signal lines SL1 to SL4 are overlapped with each other, and are not disposed at second regions of the blocking member 192 among the signal lines SL1 to SL4. In this case, since the plurality of openings 185 are not disposed in areas between the signal lines SL1 to SL4, noise which may be generated among the signal lines SL1 to SL4 may be more effectively reduced, and noise which may be generated in an adjacent negative data signal line SLn and an adjacent positive data signal line SLp may be more effectively reduced.

Similar to the embodiment shown in FIG. 2, DC voltage having predetermined level may be applied to the blocking member 192 of the illustrated embodiment in FIG. 4.

Further, since the blocking member 192 includes the plurality of openings 185 overlapping the signal lines SL1 to SL4, capacitance between the blocking member 192 and the signal lines SL1 to SL4 may be reduced and RC delay of a display panel may be reduced. In one exemplary embodiment, for example, since the blocking member 192 including the plurality of openings 185 has capacitance smaller than a blocking member not including the opening, the RC delay of the display panel are smaller.

The plurality of openings 185 may be arranged in a mesh structure where rows and columns of the openings 185 are parallel to each other, respectively, and where distances between adjacent rows and columns are substantially uniform. In the plan view, the openings 185 may have a square, a rectangular, a circular shape, and the like. The openings 185 of the blocking member 192 may all be substantially a same dimension and/or planar area, or the openings 185 may be varied in dimension and/or planar area. The single unitary indivisible blocking member 192 may have a substantially rectilinear, e.g., rectangular, shape in the plan view.

The blocking member may 192 include transparent conductive materials such as ITO, IZO, and the like. The blocking member 192 may be disposed on the same layer and include the same material as a pixel electrode 191 (FIG. 7). In one exemplary embodiment, for example, since the blocking member 192 may be formed at the same time in a process in which the pixel electrode 191 is formed, process cost may be saved.

Figure 5:
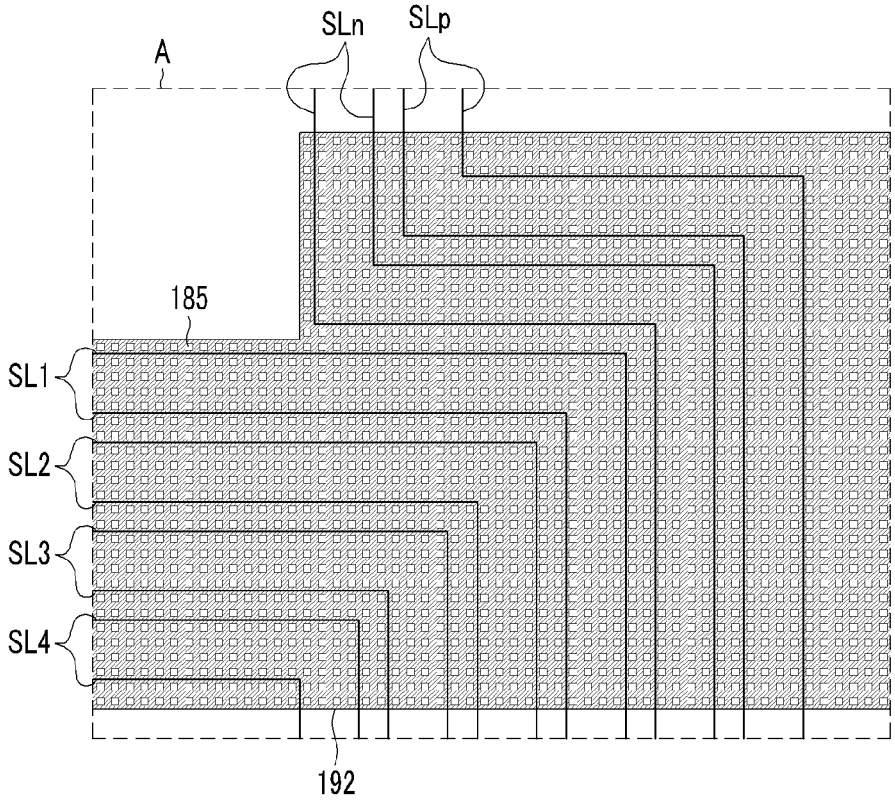
FIG. 5 is a plan view illustrating another exemplary embodiment of area A of the display panel of FIG. 1, according to the invention.

FIG. 5 is a plan view illustrating another exemplary embodiment of area A of the display panel, according to the invention.

Referring to FIG. 5, a blocking member 192 covers portions of signal lines SL1 to SL4, and portions of data signal lines SLn and SLp. That is, the blocking member 192 is overlapped with the signal lines SL1 to SL4, the data signals SLn and SLp, and regions among (e.g., between) the signal lines SL1 to SL4 and between the data signal lines SLn and SLp.

Further, the blocking member 192 receives DC voltage having predetermined level. In one exemplary embodiment, for example, the blocking member 192 may receive low voltage Vss corresponding to gate-off voltage or may receive additional voltage other than the low voltage Vss. Since the blocking member 192 covers the signal lines SL1 to SL4 and the data signal lines SLn and SLp while receiving the DC voltage having the predetermined level, the blocking member 192 may further reduce noise which may be generated among the signal lines SL1 to SL4, and may further reduce noise which may be generated in the negative data signal line SLn and positive data signal line SLp.

Further, the blocking member 192 may have a mesh structure in the plan view, including a plurality of an opening 185. Each of the openings 185 penetrates completely through a thickness of the blocking member 192, and is at a distance from edges of the single unitary indivisible blocking member 192, such that the opening 185 is an enclosed opening solely defined by the blocking member 192.

As a result of the mesh structure of the blocking member 192, capacitance between the blocking member 192 and the signal lines SL1 to SL4, and capacitance between the blocking member 192 and the data signal lines SLn and SLp may be reduced, and RC delay of a display panel may be reduced. In one exemplary embodiment, for example, since the blocking member 192 including the plurality of openings 185 has capacitance smaller than a blocking member not including the opening, the RC delay of the display panel may be smaller.

The plurality of openings 185 may be arranged in the mesh structure where rows and columns of the openings 185 are parallel to each other, respectively, and where distances between adjacent rows and columns are substantially uniform. In the plan view, the openings 185 may have a square, a rectangular, a circular shape, and the like. The openings 185 of the blocking member 192 may all be substantially a same dimension and/or planar area, or the openings 185 may be varied in dimension and/or planar area.

The blocking member 192 may include transparent conductive materials such as ITO, IZO, and the like. The blocking member 192 may be disposed on the same layer and include the same material as a pixel electrode 191 (FIG. 7). In one exemplary embodiment, for example, since the blocking member 192 may be formed at the same time in a process in which the pixel electrode 191 is formed, process cost may be saved.

In an alternative embodiment, the blocking member 192 may not cover the signal lines SL1 to SL4 and regions among the signal lines SL1 to SL4.

Figure 6:
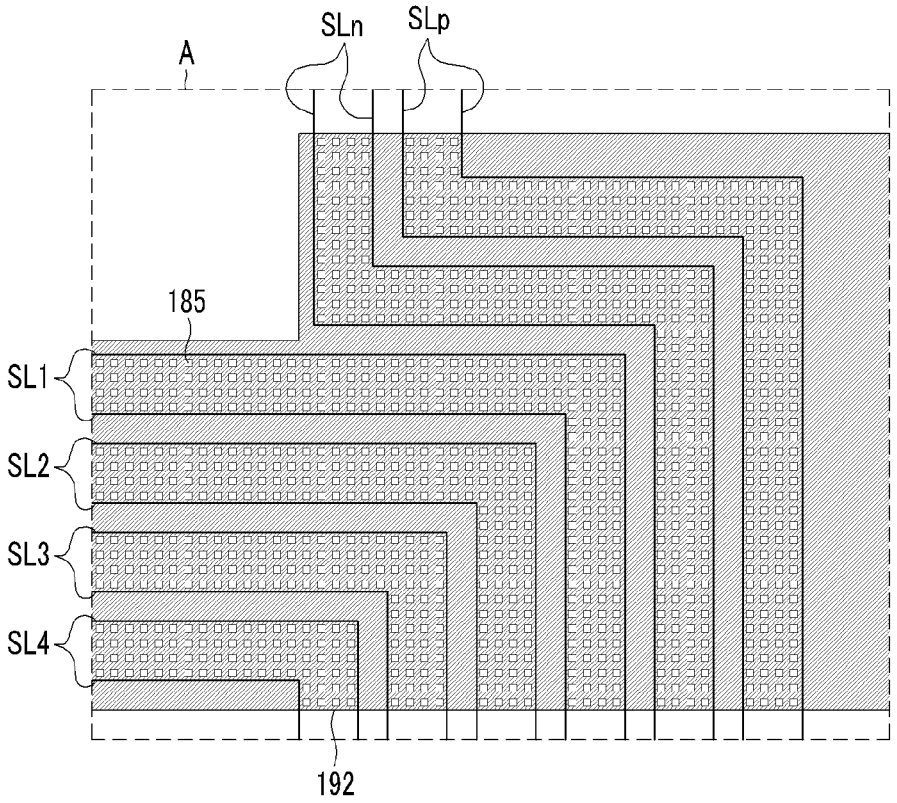
FIG. 6 is a plan view illustrating another exemplary embodiment of area A of the display panel of FIG. 1, according to the invention.

FIG. 6 is a plan view illustrating another exemplary embodiment of area A of the display panel, according to the invention.

Referring to FIG. 6, a blocking member 192 covers (e.g., overlaps) signal lines SL1 to SL4, and data signal lines SLn and SLp. That is, the blocking member 192 is overlapped with a portion of the signal lines SL1 to SL4, a portion of the data signals SLn and SLp, and portions of regions among the signal lines SL1 to SL4 and the data signal lines SLn and SLp. The blocking member 192 includes a plurality of openings 185. The plurality of openings 185 are disposed at first regions of the blocking member 192 where the blocking member 192 and the signal lines SL1 to SL4 are overlapped with each other, and at second regions of the blocking member 192 where the blocking member 192 and the data signal lines SLn and SLp are overlapped with each other. The openings 185 are not disposed in third regions of the blocking member 192 between the signal lines SL1 to SL4, and between the data signal lines SLn and SLp. In this case, since the plurality of openings 185 are not disposed in third regions between the signal lines SL1 to SL4 and between the data signal lines SLn and SLp, noise which may be generated among the signal lines SL1 to SL4 may be more effectively reduced, and noise which may be generated in the negative data signal line SLn and positive data signal line SLp may be more effectively reduced.

Similar to the embodiment described with reference to FIG. 5, DC voltage having predetermined level may be applied to the blocking member 192 of the illustrated embodiment in FIG. 5.

Further, the blocking member 192 may have a mesh structure including the plurality of openings 185 and as a result, capacitance between the blocking member 192 and the signal lines SL1 to SL4, and capacitance between the blocking member 192 and the data signal lines SLn and SLp may be reduced, and RC delay of a display panel may be reduced. In one exemplary embodiment, for example, since the blocking member 192 including the plurality of openings 185 has capacitance smaller than a blocking member not including the opening, the RC delay of the display panel are smaller.

The plurality of openings 185 may be arranged in the mesh structure where rows and columns of the openings 185 are parallel to each other, respectively, and where distances between adjacent rows and columns are substantially uniform. The openings 185 may have a square, a rectangular, a circular shape, and the like. The openings 185 of the blocking member 192 may all be substantially a same dimension and/or planar area, or the openings 185 may be varied in dimension and/or planar area.

The blocking member 192 may include transparent conductive materials such as ITO, IZO, and the like. The blocking member 192 may be disposed on the same layer and include the same material as a pixel electrode 191 (FIG. 7). In one exemplary embodiment, for example, since the blocking member 192 may be formed at the same time in a process in which the pixel electrode 191 is formed, process cost may be saved.

In an alternative embodiment, the blocking member 192 may not cover the signal lines SL1 to SL4 and regions among the signal lines SL1 to SL4.

Figure 8:
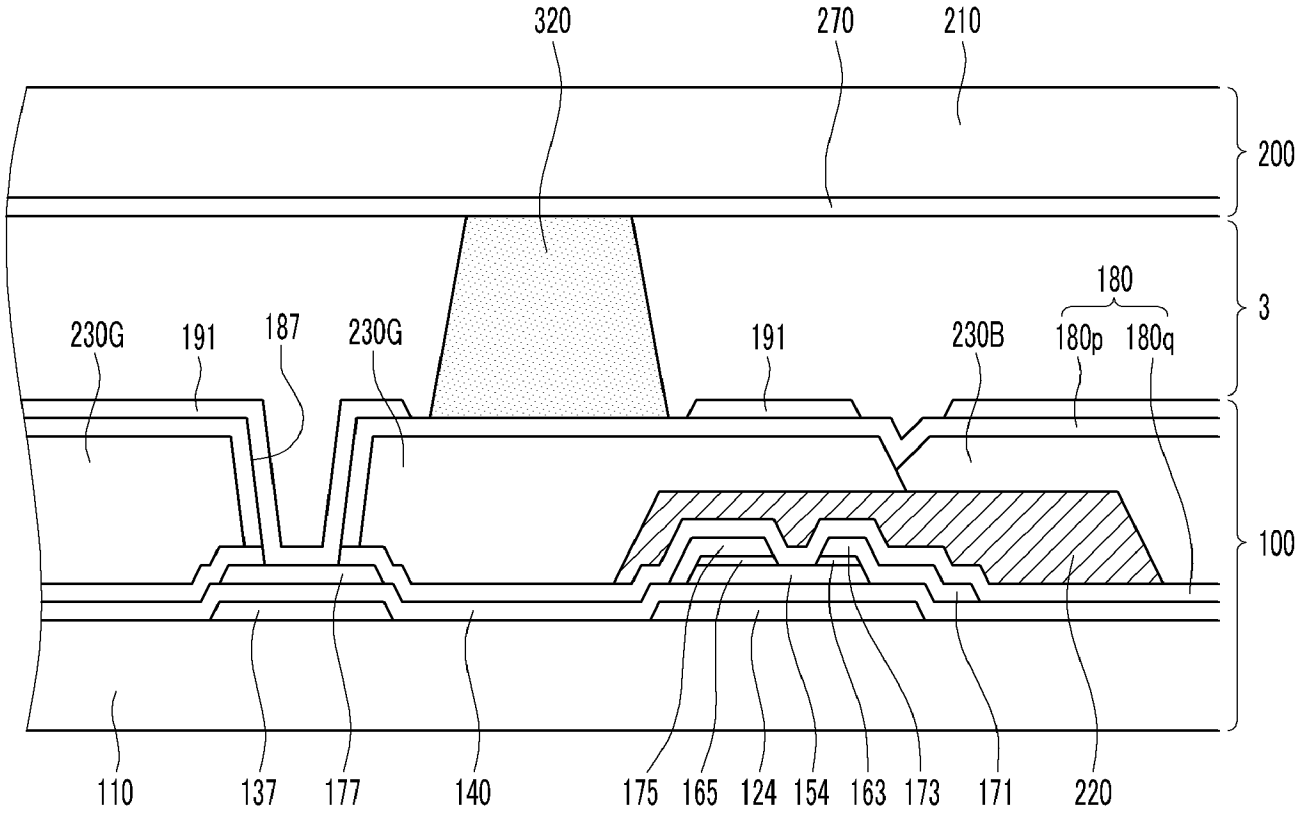
FIG. 8 is a cross-sectional view taken along line VIII-VIII in the plan view of FIG. 7.

FIG. 7 is a plan view illustrating a portion of the display area of the display panel of FIG. 1, and FIG. 8 is a cross-sectional view taken along line VIII-VIII in the plan view of FIG. 7.

Referring to FIGS. 7 and 8, the liquid crystal display panel includes a first display panel 100, a second display panel 200, and a liquid crystal layer 3.

Alignment layers (not shown) may be on inner surfaces of the first display panel 100 and/or the second display panel 200, and the alignment layers may be horizontal alignment layers. Polarizers (not shown) may be provided on outer surfaces of the first display panel 100 and/or the second display panel 200.

A display area DA of a liquid crystal display panel is an area actually outputting images. A peripheral area PA is an area on the periphery of the display area DA, includes various wires and excludes the display area DA.

A gate line 121 and a storage electrode line 131 are disposed on a first insulating substrate 110 which includes a transparent glass or plastic. The gate line 121 includes a gate electrode 124 extended from a main portion of the gate line 121. The storage electrode line 131 includes a storage electrode 137 extended from a main portion of the storage electrode line 131. A shape and a disposition of the storage electrode line 131 may be variously modified, and in an alternative embodiment, the storage electrode line 131 may be omitted.

A gate insulating layer 140 including an inorganic material such as silicon nitride (SiNx) or silicon oxide (SiOx), or an organic material, is disposed directly on and overlapping the gate line 121 and the storage electrode line 131. The gate insulating layer 140 may be on substantially an entire of the first insulating substrate 110.

A semiconductor 154 including hydrogenated amorphous silicon (amorphous silicon is referred to as an abbreviation "a-Si"), or polysilicon is disposed directly on and overlapping the gate insulating layer 140.

Ohmic contacts 163 and 165 are disposed directly on the semiconductor 154. The ohmic contacts 163 and 165 may include n+hydrogenated amorphous silicon doped with n-type impurities such as phosphorus, and the like with a high concentration, silicide, and the like.

A data line 171 and a drain electrode 175 are disposed directly on and contacting the ohmic contacts 163 and 165, and the gate insulating layer 140. The data line 171 includes a source electrode 173 extended from a main portion of the data line 171 and bent in a "U" shape lying on its side (e.g., a "C" shape in the plan view). Alternatively, the source electrode 173 may have various shapes in addition to the "U" shape. The drain electrode 175 is separated from the data line 171, and includes a narrow portion and a wide portion 177.

The gate electrode 124, the source electrode 173, and the drain electrode 175 constitute a thin film transistor ("TFT"), together with the semiconductor 154. A channel of the TFT is disposed overlapping the semiconductor 154 in an area between the source electrode 173 and the drain electrode 175.

The ohmic contacts 163 and 165 are disposed only between the semiconductor 154 and the data line 171, and the semiconductor 154 and the drain electrode 175 thereon, and reduce contact resistances therebetween. The channel of the TFT includes an exposed part of the semiconductor 154 which is not covered with the data line 171 and the drain electrode 175.

A passivation layer 180 is disposed on the data line 171, the drain electrode 175, and the exposed part of the semiconductor 154. The passivation layer 180 includes an upper film 180*p* and a lower film 180*q* including an inorganic insulator such as silicon nitride or silicon oxide, or an organic insulator. In an alternative embodiment, the upper film 180*p* or the lower film 180*q* may be omitted. A contact hole 187 for exposing the wide portion 177 of the drain electrode 175 is extended completely through the passivation layer 180.

A light shielding member (e.g., black matrix) 220 is disposed directly on portions of the lower film 180*q*. In an alternative embodiment, the light shielding member 220 may be disposed on the second display panel 200, and not on the first display panel 100 as shown in FIG. 8.

Color filters 230R, 230G, and 230B are disposed between the upper film 180*p* and the lower film 180*q*. The color filters 230R, 230G, and 230B may occupy regions between adjacent data lines 171, and may have a strip shape that elongates vertically (e.g., in the first direction) parallel to the data line 171. A strip shape may indicate having a dimension in the first direction that is larger than a dimension in a second direction perpendicular to the first direction. The contact hole 187 disposed on the wide portion 177 of the drain electrode 175 is disposed extending completely through a thickness of the color filters 230R, 230G, and 230B. The color filters 230R, 230G, and 230B may include a photosensitive organic material including a pigment. Alternatively, the color filters 230R, 230G, and 230B may be disposed on the second display panel 200, and not on the first display panel 100.

The pixel electrode 191 is directly on the upper film 180*p* of the passivation layer 180. The pixel electrode 191 may include a transparent conductive material such as ITO, IZO, or the like. In the case in which the color filters 230R, 230G, and 230B are on the second display panel 200, the pixel electrode 191 may include the transparent conductive material and/or a reflective metal such as aluminum, silver, chrome, or an alloy thereof.

The pixel electrode 191 is electrically and physically connected with the drain electrode 175 of the TFT through the contact hole 187, and receives data voltage from the drain electrode 175. The pixel electrode 191 that receives the data voltage generates an electric field together with a common electrode 270 of the second display panel 200, to determine the orientation of liquid crystal molecules of the liquid crystal 3 between the pixel electrode 191 and the common electrode 270. The luminance of light passing through the liquid crystal layer 3 depends on the orientation of the liquid crystal molecules determined as above.

A spacer 320 may include an organic material, and the like, and is disposed in the display area DA of the liquid crystal display panel. Further, the spacer 320 maintains an interval between the first display panel 100 and the second display panel 200.

In the second display panel 200, the common electrode 270 is disposed on a second insulating second substrate 210. The common electrode 270 may include a transparent conductor such as ITO, IZO, or the like, etc. and receives common voltage. An overcoat (not shown), an alignment layer (not shown), and the like may be disposed on an inner surface of the common electrode 270.

Figure 9:
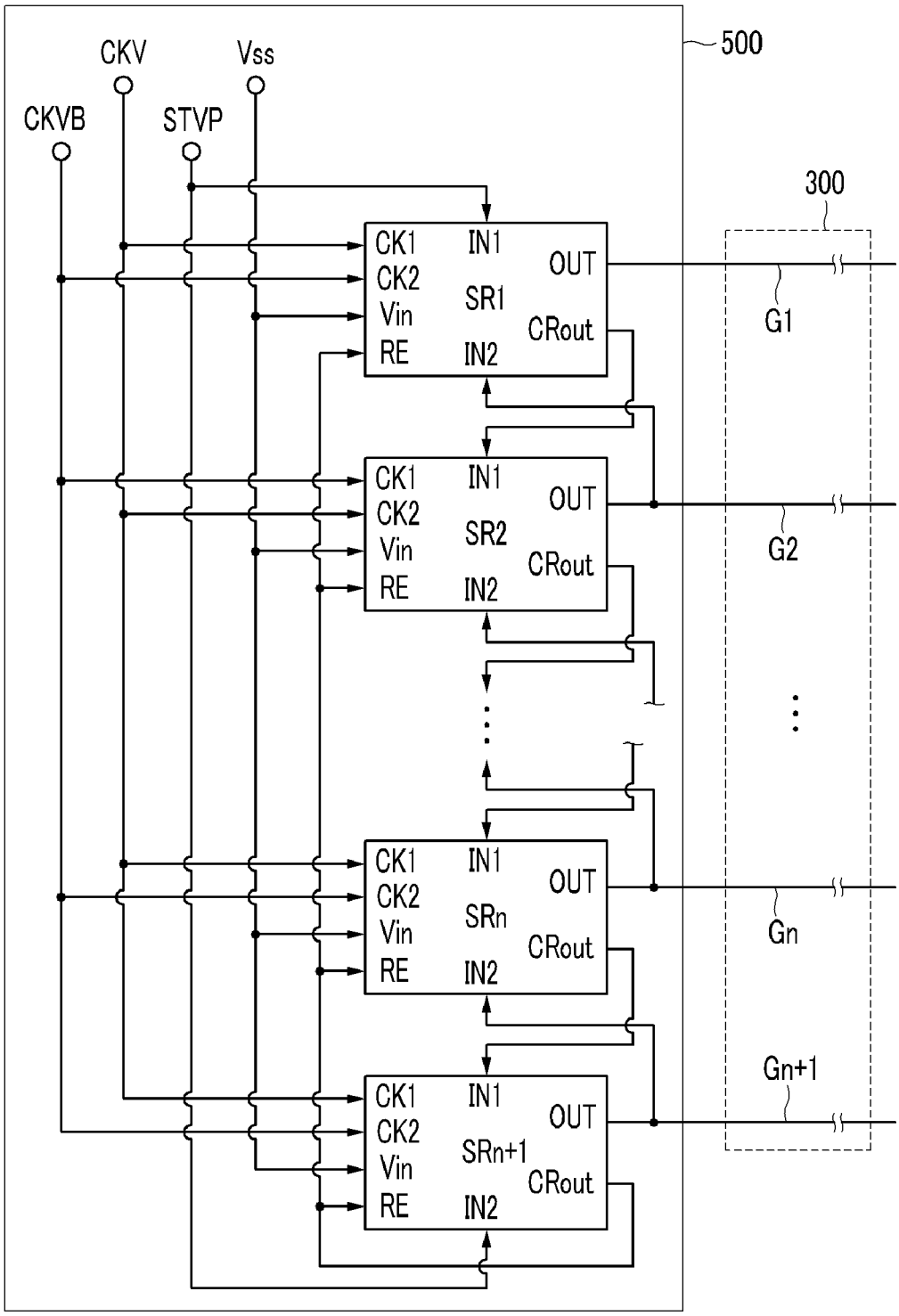
FIG. 9 is a block diagram illustrating an exemplary embodiment of the gate driver and the gate line of the display panel of FIG. 1.
Figure 10:
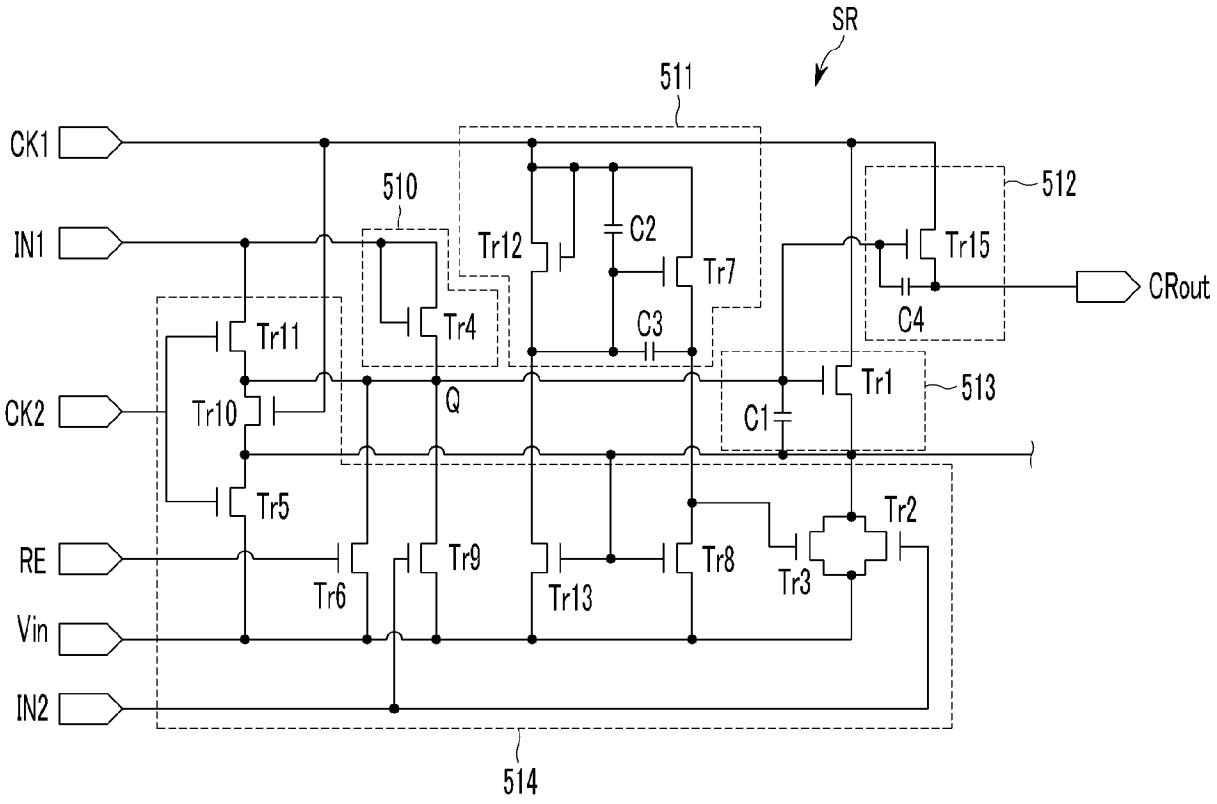
FIG. 10 is a circuit diagram illustrating an exemplary embodiment of one stage in the block diagram of FIG. 9.

FIG. 9 is a block diagram illustrating an exemplary embodiment of the gate driver and the gate line of the display panel of FIG. 1, and FIG. 10 is an exemplary embodiment of a circuit diagram illustrating one stage in the block diagram of FIG. 9.

Referring to FIG. 9, the blocking member 192 may cover a portion of each of a scan start signal SL1 transmitting a scan start signal STVP, clock signal lines SL2 and SL3 transmitting clock signals CKV and CKVB, and a voltage signal line SL4 for transmitting low voltage Vss. As shown in FIGS. 2 to 6, the blocking member 192 may have various shapes and as a result, noise and RC delay may be reduced.

Referring to FIG. 9, a gate driver 500 includes a plurality of stages SR1 to SRn+1 that are dependently connected with each other. Each of the stages SR1 to SRn+1 includes two input terminals IN1 and IN2, two clock input terminals CK1 and CK2, a voltage input terminal Vin receiving the low voltage Vss corresponding to the gate-off voltage, a reset terminal RE, an output terminal OUT, and a transmission signal output terminal CRout.

The first input terminal IN1 of a stage is connected to the transmission signal output terminal CRout of the previous stage, to receive a transmission signal CR of the previous stage. Since the first stage has no previous stage, the first stage receives the scan start signal STVP through the first input terminal IN1.

The second input terminal IN2 of a stage is connected with the output terminal OUT of the subsequent stage to receive gate voltage of the subsequent stage. Since an n+1-th stage SRn+1 (dummy stage) as the last stage has no subsequent stage, the n+1-th stage receives the scan start signal STVP through the second input terminal IN2.

The first clock signal CKV is applied to the first clock terminal CK1 of odd number-th stages among the plurality of stages, and the second clock CKVB signal having an inverted phase is applied to the second clock terminal CK2 of the odd numbered stage. Conversely, the second clock signal CKVB is applied to the first clock terminal CK1 of even number-th stages, and the first clock signal CKV is applied to the second clock terminal CK2 of the even numbered stage. Compared with the odd number-th stages, the phases of the clocks inputted into the same terminal are inverted to each other.

The low voltage Vss corresponding to the gate-off voltage is applied to the voltage input terminal Vin of each stage, and the transmission signal output terminal CRout of the dummy stage SRn+1 disposed last is connected to the reset terminal RE of each of the stages.

Herein, the dummy stage SRn+1 is a stage that generates and outputs dummy gate voltage unlike other stages SR1 to SRn. That is, while the gate voltages outputted from other stages SR1 to SRn are transmitted through the gate lines and data voltage is applied to a pixel to form images, the dummy stage SRn+1 may not be connected to the gate line. Even though the dummy stage SRn+1 may be connected with the gate line, the dummy stage SRn+1 is connected with a gate line of a dummy pixel (not shown) that does not display images, such that the dummy stage SRn+1 is not used to display the images. (See FIG. 2)

An operation of the gate driver 500 will be described below.

The first stage SR1 receives the first and second clock signals CKV and CKVB provided from the outside through the first clock input terminal CK1 and the second clock input terminal CK2, respectively, the scan start signal STVP through the first input terminal IN1, the low voltage Vss corresponding to the gate-off voltage through the voltage input terminal Vin, and the gate voltage (voltage outputted from the terminal OUT) provided from the second stage SR2 through the second input terminal IN2. The first stage SR1 outputs the gate voltage to the first gate line G1 through the output terminal OUT, outputs the transmission signal CR from the transmission signal output terminal CRout and transmits the transmission signal CR to the first input terminal IN1 of the second stage SR2.

The second stage SR2 receives the second clock signal CKVB and the first clock signal CKV provided from the outside through the first and second clock terminals CK1 and CK2, respectively, the transmission signal CR of the 1-th stage SR1 through the first input terminal IN1, the low voltage Vss corresponding to the gate-off voltage through the voltage input terminal Vin, and the gate voltage provided from the third stage SR3 through the second input terminal IN2. The second stage SR2 outputs the gate voltage to the first stage SR1 through the output terminal OUT, and outputs gate voltage to the second gate line G2 through the output terminal OUT, and outputs the transmission signal CR from the transmission signal output terminal CRout and transmits the transmission signal CR to the first input terminal IN1 of the third stage SR3.

In the same manner as above, the n-th stage SRn receives the first and second clock signals CKV and CKVB provided from the outside through the first and second clock terminals CK1 and CK2, respectively, the transmission signal CR of the n−1-th stage SRn−1 through the first input terminal IN1, the low voltage Vss corresponding to the gate-off voltage through the voltage input terminal Vin, and the gate voltage provided from the n+1-th stage SRn+1 through the second input terminal IN2. The n-th stage SRn outputs the gate voltage to the n-th gate line Gn through the output terminal OUT and outputs the gate voltage to the previous stage SRn−1 through the output terminal OUT, and outputs the transmission signal CR from the transmission signal output terminal CRout and transmits the transmission signal CR to the first input terminal IN1 of the n+1-th dummy stage SRn+1.

Next, referring to FIG. 10, the structure of one stage SR will be described.

Referring to FIG. 10, each stage SR of the gate driver 500 includes an input unit 510, a pull-up driving unit 511, a transmission signal generation unit 512, an output unit 513, and a pull-down driving unit 514.

The input unit 510 includes one transistor (fourth transistor Tr4). An input terminal and a control terminal of the fourth transistor Tr4 are commonly connected (diode-connected) to the first input terminal IN1, and an output terminal of the fourth transistor Tr4 is connected with a Q-contact point (hereinafter, also referred to as first node). When high voltage is applied to the first input terminal IN1, the input unit 510 serves to transmit the high voltage to the Q-contact point.

The pull-up driving unit 511 includes two transistors (seventh transistor Tr7 and twelfth transistor Tr12, and two capacitors (second capacitor C2 and third capacitor C3). First, a control terminal and an input terminal of the twelfth transistor Tr12 are commonly connected to receive the clock signals CKV and CKVB (depending on the stage) through the first clock terminal CK1, and an output terminal of the twelfth transistor Tr12 is connected to the pull-down driving unit 514.

In addition, an input terminal of the seventh transistor Tr7 also receives the clock signals CKV and CKVB (depending on the stage) through the first clock terminal CK1, and a control terminal and an output terminal of the seventh transistor Tr7 is connected to the pull-down driving unit 514. Herein, the second capacitor C2 is connected between the input terminal and the control terminal of the seventh transistor Tr7, and the third capacitor C3 is connected between the control terminal and the output terminal of the seventh transistor Tr7.

The transmission signal generation unit 512 includes one transistor (fifteenth transistor Tr15) and one capacitor (fourth capacitor C4). The clock signals CKV and CKVB (depending on the stage) are inputted into an input terminal of the fifteenth transistor Tr15 through the first clock terminal CK1, and a control terminal of the fifteenth transistor Tr15 is connected to an output of the input unit 510, that is, the Q-contact point. The control terminal and an output terminal of the fifteenth transistor Tr15 are connected to the fourth capacitor C4. The transmission signal generation unit 512 outputs the transmission signal CR in accordance with voltage at the Q-contact point and the clock signals CKV and CKVB.

The output unit 513 includes one transistor (first transistor Tr1) and one capacitor (first capacitor C1). A control terminal of the first transistor Tr1 is connected to the Q-contact point, and an input terminal receives the clock signals CKV and CKVB (depending on the stage) through the first clock terminal CK1. The control terminal and an output terminal of the first transistor Tr1 are connected to the first capacitor C1, and the output terminal is connected to the gate lines G1 to Gn+1. The output unit 513 outputs the gate voltage according to the voltage at the Q-contact point and the clock signals CKV and CKVB.

The pull-down driving unit 514 is a part for smoothly outputting the gate-off voltage by removing electric charges existing on the stage SR, and may serve to lower a potential at the Q-contact point and lower the voltage outputted to the gate line. The pull-down driving unit 514 include nine transistors (second transistor Tr2, third transistor Tr3, fifth transistor Tr5, sixth transistor Tr6, eighth transistor Tr8 to eleventh transistor Tr11, and thirteenth transistor Tr13).

First, the fifth transistor Tr5, the tenth transistor Tr10, and the eleventh transistor Tr11 are, in series, connected between the first input terminal IN1 into which the transmission signal CR of the previous stage SRn−1 is inputted, and the voltage input terminal Vin to which the low voltage Vss corresponding to the gate-off voltage is applied. The clock signals CKV and CKVB (depending on the stage) are inputted into control terminals of the fifth and eleventh transistors Tr5 and Tr11 through the second clock terminal CK2, and the clock signals CKV and CKVB (depending on the stage) are inputted into a control terminal of the tenth transistor Tr10 through the first clock terminal CK1. In this case, the clock signals CKV and CKVB inputted into the first clock terminal CK1 and the second clock terminal CK2 have different phases. Further, the Q-contact point is connected between the eleventh transistor Tr11 and the tenth transistor Tr10, and an output terminal of the first transistor Tr1 of the output unit 513, that is, the gate lines G1 to Gn+1 are connected between the tenth transistor Tr10 and the fifth transistor Tr5.

A pair of transistors Tr6 and Tr9 are, in parallel, connected between the Q-contact point and the low voltage Vss. The transmission signal CR of the dummy stage is applied to a control terminal of the sixth transistor Tr6 through the reset terminal RE, and the gate voltage of the subsequent stage is inputted into a control terminal of the ninth transistor Tr9 through the second input terminal IN2.

A pair of transistors Tr8 and Tr13 are connected between output terminals and low-potential levels Vss of two transistors Tr7 and Tr12 of the pull-up driving unit 511, respectively. Control terminals of the eighth and thirteenth transistors Tr8 and Tr13 are commonly connected to the output terminal of the first transistor Tr1 of the output unit 513, that is, the gate lines G1 to Gn+1.

Lastly, a pair of transistors Tr2 and Tr3 are, in parallel, connected between an output of the output unit 513 and the low-potential level Vss. A control terminal of the third transistor Tr3 is connected to an output terminal of the seventh transistor Tr7 of the pull-up driving unit 511, and the gate voltage of the subsequent stage is inputted into a control terminal of the second transistor Tr2 through the second input terminal IN2.

When the pull-down driving unit 514 receives the gate voltage of the subsequent stage through the second input terminal IN2, the pull-down driving unit 514 serves to convert the voltage at the Q-contact point into the low voltage Vss through the ninth transistor Tr9 and to convert the voltage outputted to the gate line into the low voltage Vss through the second transistor Tr2. Further, when the pull-down driving unit 514 receives the transmission signal CR of the dummy stage through the reset terminal RE, the pull-down driving unit 514 converts the voltage at the Q-contact point into the low voltage through the sixth transistor Tr6 once more. High voltage is applied to the second clock terminal CK2 applied with a voltage having a phase different from the voltage applied to the first clock terminal CK1, the pull-down driving unit 514 converts the voltage outputted to the gate lines G1 to Gn+1 into the low voltage Vss through the fifth transistor Tr5.

The transistors Tr1 to Tr13 and Tr15 within the stage SR may be NMOS transistors.

The gate voltage outputted from the stage SR is transmitted through the gate lines G1 to Gn+1.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display panel, comprising:

a display area comprising a gate line and a data line;

a gate driver on a substrate and connected to one end of the gate line, the gate driver comprising a plurality of stages;

a plurality of signal lines connected to the stages; and a blocking member defining:

a plurality of mesh portions thereof respectively overlapping the signal lines, the mesh portions defining a plurality of openings therein, and a plurality of solid planar portion thereof disposed non-overlapping the signal lines and in which the openings are not defined, wherein within the blocking member, the mesh portions and the solid planar portion alternate with each other.

2. The display panel of claim 1, wherein:

the signal lines are disposed at the same layer as the gate line or the data line.

3. The display panel of claim 1, wherein:

direct current voltage is applied to the blocking member.

4. The display panel of claim 3, wherein:

the direct current voltage is low voltage.

5. The display panel of claim 1, wherein:

the signal lines comprise at least one of a scan signal line and a clock signal line.

6. The display panel of claim 5, wherein:

each of the stages comprises a clock input terminal, and the clock signal line is connected to the clock input terminal.

7. The display panel of claim 5, wherein:

the signal lines comprise a voltage signal line which applies low voltage.

8. The display panel of claim 7, wherein:

each of the stages comprises a voltage input terminal, and the voltage signal line is connected to the voltage input terminal.

9. The display panel of claim 1, further comprising:

a signal controller controlling the gate driver, wherein the signal line connects the gate driver with the signal controller.

10. The display panel of claim 1, wherein:

each of the mesh portions has a mesh shape in a plan view of the display panel.

11. The display panel of claim 1, wherein:

the blocking member comprises a transparent conductive material.

12. The display panel of claim 1, further comprising:

a pixel electrode disposed on the gate line and the data line, wherein the blocking member is disposed at the same layer as the pixel electrode.

13. The display panel of claim 1, further comprising:

a data driver applying data voltage to the data line, wherein the signal lines comprise a data signal line connected to the data driver, and wherein the blocking member is disposed on the data signal line and is overlapped with the data signal line.

14. The display panel of claim 13, wherein:

the data signal line comprises at least one of a negative data signal line and a positive data signal line.

15. The display panel of claim 13, further comprising:

a signal controller controlling the data driver, wherein the data signal line connects the data driver with the signal controller.

16. The display panel of claim 13, wherein:

within the blocking member, among the alternating mesh portions and solid planar portions, a first portion of the mesh portions is disposed overlapping the data signal line.

17. The display panel of claim 16, wherein:

within the blocking member, among the alternating mesh portions and solid planar portions, a second portion of the mesh portions is disposed overlapping a region where the data signal line and the blocking member are not overlapped with each other.

18. The display panel of claim 16, wherein:

within the blocking member, among the alternating mesh portions and solid planar portions, a portion of the solid planar portions is disposed overlapping a region where the data signal line and the blocking member are not overlapped with each other.

19. The display panel of claim 1, wherein:

each of the stages comprises a first input terminal, a second input terminal, an output terminal, and a transmission signal output terminal, and the stages comprise a first stage and a second stage, wherein a transmission signal output terminal of the first stage is connected to a first input terminal of the second stage, and a second input terminal of the first stage is connected to an output terminal of the second stage.

20. The display panel of claim 19, wherein:

the signal lines comprise a scan start signal line connected to the first input terminal of the first stage.

* * * * *